United States Patent [19]

Braden

[11] 3,969,097

[45] July 13, 1976

[54] SLAB COMPLETION THERMOSTAT WITH TIME DELAY FUNCTION

[75] Inventor: Ralph S. Braden, Bellbrook, Ohio

[73] Assignee: General Motors Corporation, Detroit, Mich.

[22] Filed: June 23, 1975

[21] Appl. No.: 589,471

[52] U.S. Cl. ..... 62/137; 62/138

[51] Int. Cl.[2] ..... F25C 1/12

[58] Field of Search ..... 62/137, 138, 352

[56] References Cited

UNITED STATES PATENTS

| | | | |
|---|---|---|---|
| 2,784,563 | 3/1957 | Baker | 62/138 |
| 3,859,813 | 1/1975 | Canter | 62/138 |

*Primary Examiner*—William E. Wayner

*Attorney, Agent, or Firm*—J. C. Evans

[57] ABSTRACT

A slab type ice maker including an inclined refrigerated plate assembly is associated with a mechanically driven refrigerant compressor to cool the plate below freezing during an ice making cycle of operation whereby water circulated thereover by means of a motor driven pump will produce an ice slab thickness on the plate which is removed therefrom during a hot gas defrost harvest cycle of operation to be directed onto a heated grid for separation into individual cubes which are collected in a storage bin having a bin level thermostat therein that operates when the bin is filled to terminate machine operation. A control circuit associated with the bin level thermostat switch includes a bimetallic thermostat associated with the bin switch to maintain the machine operative after bin fill to assure completion of a desired ice slab thickness on the plate assembly and further includes means to establish a hot gas defrost operation which is terminated by the bimetallic thermostat sensing flow of hot defrost gas to produce a time delay control of hot gas harvest of the slab with subsequent complete termination of machine operation when the bin is filled with ice.

2 Claims, 3 Drawing Figures

SLAB COMPLETION THERMOSTAT WITH TIME DELAY FUNCTION

This invention relates to slab type ice maker machines having automatically controlled ice making and defrost cycles of operation and more particularly to an improved control circuit for terminating machine operation following a maximum buildup of ice in a bin storage cavity followed by a limited machine operation required to build up a predetermined ice slab thickness on the plate assembly and further including means operative to produce a time delayed hot gas defrost of the plate assembly responsive to hot gas flow through the refrigerant circuit to terminate machine operation once the slab is subjected to the hot gas defrost operation.

Slab type ice makers of the type set forth in U.S. Pat. No. 2,784,563 issued Mar. 12, 1957, to M. W. Baker include a control circuit that utilizes a thermostatically responsive bin switch to sense a maximum build up of ice in the machine to terminate machine operation once a predetermined accumulation of ice is present in the storage bin. Such systems can include an electromagnetic latch type relay to bypass the bin switch to maintain machine operation until a desired ice slab thickness is produced on an inclined refrigerated plate component of the machine. Thereafter, the ice slab remains on the evaporator plate until ambient conditions in the machine cause the refrigerated plate to reach a temperature at which the slab will be released therefrom for movement onto an electrically energized grid thereafter to be divided into individual ice cube components. The release time afforded by such control depends upon ambient conditions including temperature and humidity. As a result, often the completed ice slab is retained on the evaporator plate for a considerable period of time. It has been observed that is some cases the quality of the ice slab deteriorates and has a lesser clarity than in a case where an ice slab is harvested in accordance with a normal progression of machine control sequences which include energization of a hot gas solenoid to produce a flow of hot gas through the evaporator to release the slab each time it attains the desired thickness upon the refrigerated plate. However, in the case of a machine sequence wherein the bin thermostatic switch is operated to terminate machine operation the only additional control action is by means of the electromagnetic relay which merely bypasses the bin switch in order to build up the slab of ice without a normal progression of hot gas defrost to remove the slab from the plate.

Accordingly, an object of the present invention is to improve existing control circuits for automatic slab type ice makers by the provision therein of means to maintain a slab type ice maker operative once its bin is filled with ice until a predetermined slab thickness is produced on a refrigerated plate therein and thereafter initiating a hot gas defrost operation that is terminated in accordance with the temperature of refrigerant gas passing through the inlet of an ice maker evaporator to produce a time delayed control of ice slab defrost following bin filled and with the defrost cycle being terminated when hot gas is sensed in the evaporator inlet to concurrently terminate the defrost operation and further machine operation in accordance with bin fill conditions.

Still another object of the invention is to provide an improved control circuit for a slab type ice maker of the type including a thermostatic type bin level switch for terminating machine operation when a bin storage cavity in the ice maker is filled with ice wherein a bimetallic element is connected electrically in parallel with the bin switch and located to sense the temperature of the inlet tube to an evaporator on an inclined refrigerated plate in the machine with the bimetallic element being maintained normally closed during an ice making cycle of operation and with the circuit including means for sensing the build up of a predetermined ice slab thickness on the plate and operative to initiate a hot gas defrost cycle of operation for removing the ice slab from the refrigerated plate; the bimetallic element sensing the presence of hot gas flow through the inlet of the evaporator during the hot gas defrost cycle to assure release of an ice slab from the plate when the bin is filled to maintain ice quality and clarity and to terminate machine operation upon the combined occurrence of a flow of hot gas through the evaporator and the conditioning of the bin switch in response to bin fill.

Further objects and advantages of the present invention will be apparent from the following description, reference being had to the accompanying drawing wherein a preferred embodiment of the present invention is clearly shown.

Figure 1:
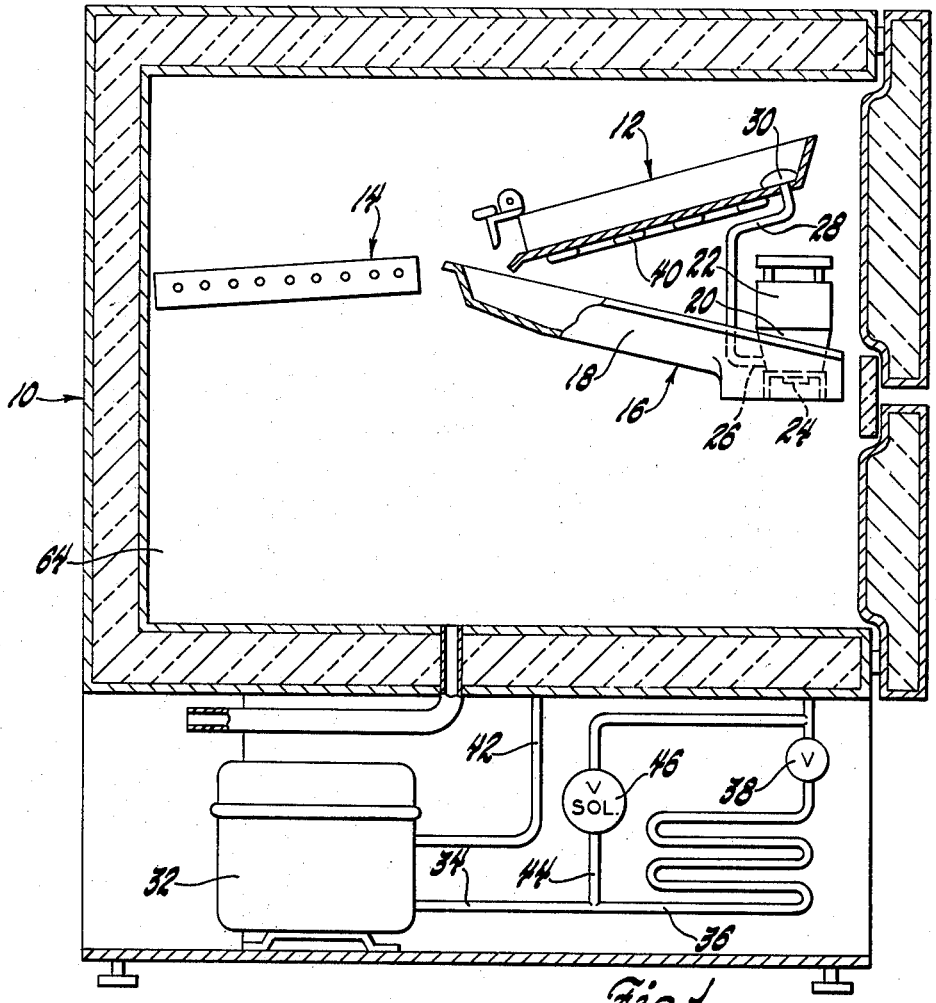
FIG. 1 is a diagrammatic view of an inclined refrigerated plate slab type ice maker with cutting grids for separating an ice slab into individual cubes.

Referring now to the drawing, an ice maker of the slab type is illustrated at 10 including an inclined refrigerated plate assembly 12 located above and to one side of a heated grid assembly 14 that receives an ice slab from the refirgerated plate assembly 12 following an ice slab formation or ice making cycles of operation to separate the slab into individual cubes. During the ice making cycles a water recirculation system 16 is operated to recirculate water across the inclined refrigerated plate assembly 12 to be frozen thereon as an ice slab that adheres to the plate assembly 12. Water circulated during the ice making cycle of operation is returned from the plate assembly 12 to a water reservoir 18 and is recirculated therefrom by a pump 20 driven by an electric motor 22.

The water recirculation circuit is from the reservoir 18 through a pump inlet 24 thence through a pump outlet 26 to a water supply conduit 28 connected to a water distributor header 30 at the upper end of the inclined refrigerated plate assembly 12.

Figure 3:
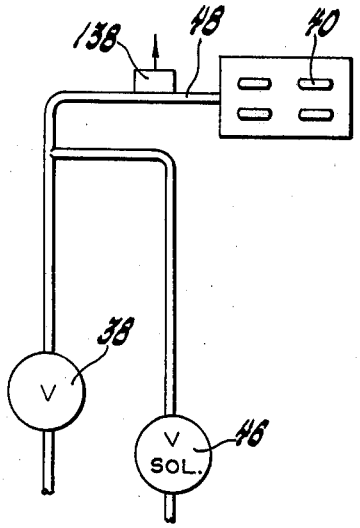
FIG. 3 is a diagrammatic view of control and refrigerant components in the ice maker of FIG. 1.

During the ice making cycles of operation an ice slab is built up on the plate assembly 12 which is cooled below freezing by means of a refrigerant system that includes an electric motor driven compressor 32 having its discharge connected by an outlet conduit 34 to one end of a condenser 36 that cools hot refrigerant gas discharged from the compressor 32. Refrigerant from the condenser 36 is expanded across a restrictor valve 38, or equivalent capillary tube, and the refrigerant is thence passed through an evaporator coil 40 on the bottom of the inclined refrigerated plate assembly 12 for reducing the temperature thereof below freezing. A refrigerant return conduit 42 communicates the outlet of the evaporator coil 40 with the inlet to the compressor 32 to complete the refrigerant circuit. The circit further includes a hot gas bypass tube 44 having a solenoid controlled valve 46 therein to selectively connect the outlet conduit 34 from the compressor 32 directly across the condenser 36 and restrictor valve 38 thereby to direct hot gas through the inlet 48 of the evaporator 40 as shown in FIG. 3.

The above illustrated ice maker 10 is representative of automatic ice making apparatus of the type more particularly set forth in the aforementioned Baker patent wherein detail explanation of the configuration and component parts of such ice makers is more specifically set forth. The above explanation, however, will suffice for an understanding of the improved operation of the control circuit of the present invention.

Figure 2:
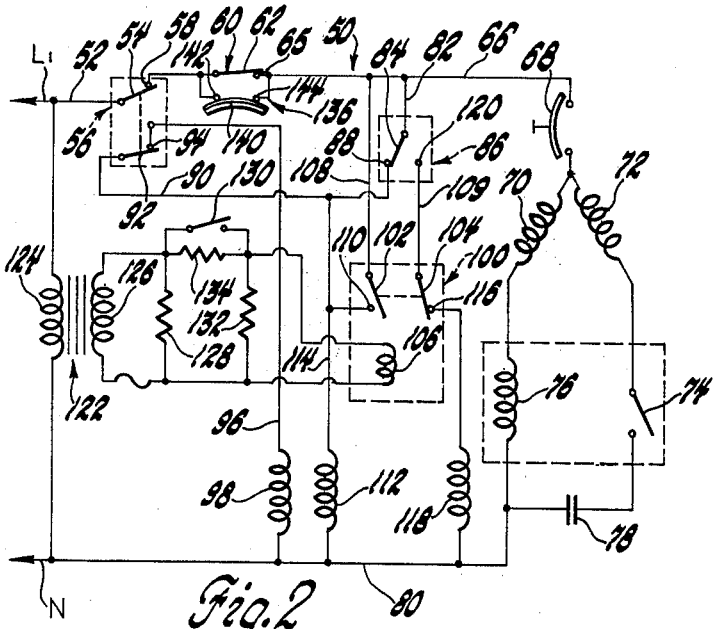
FIG. 2 is a circuit diagram including the electrical components of a preferred embodiment of the present invention.

Referring now to FIG. 2, the machine 10 is in part under the control of a circuit 50 which includes a compressor motor energization circuit across wires L-1, N defined by a conductor 52 connected across a movable pole 54 of a service switch 56 that makes contact with a fixed contact 58 connected to one terminal of a bin thermostat switch 60 including a movable contact 62 thermally responsive to a maximum build up of ice in a bin storage cavity 64 of the ice maker 10 located below the grid 14. The bin thermostat switch 60 includes a fixed contact 65 electrically connected by conductor 66 to a thermal overload switch 68 that protects the compressor drive motor. The drive motor includes windings 70, 72 and a motor start circuit including a start relay with a switch 74 controlled by a coil 76 to connect the motor winding across a capacitor 78 in a motor start mode. The capacitor 78 is connected by a conductor 80 to wire N.

Additionally, the circuit includes a pump motor energization circuit that is electrically connected from wire L-1 through the movable contact 54 of the service switch 56 thence through conductor 66 and a conductor 82 to a movable contact 84 of an ice thickness control switch 86. As shown in FIG. 2, the movable contact 84 is in engagement with a fixed contact 88 electrically connected by a conductor 90 to a second movable contact 92 of the service switch 56 which engages a fixed contact 94 connected by a conductor 96 to one terminal of a winding 98 of the pump motor 22. The opposite terminal thereof is electrically connected to the conductor 80 and wire N.

Additionally, the circuit includes a defrost or ice harvest relay 100 that includes movable contacts 102, 104 controlled by a coil 106 between an ice making and a defrost position. Contacts 102, 104 are connected respectively to conductors 108, 109. In the ice making position the movable contact 102 is in electrical contact with the fixed contact 110 to complete a circuit for a condenser fan motor 112 from conductor 108 to a conductor 114 at one terminal thereof and having its opposite terminal connected to the conductor 80.

When the harvest relay 100 is in a defrost cycle mode the circuit for the condenser fan motor winding 112 is opened as seen in FIG. 2 with a contact 102 being spaced from fixed contact 110 and the movable contact 104 is in electrical contact with a fixed contact 116 to condition a hot gas defrost circuit including a solenoid coil 118 for completion when the movable contact 84 of the ice thickness thermostat 86 moves against a back contact 120 to complete energization of the solenoid coil 118 between wires L-1 and N. This opens valve 46 to direct hot gas defrost through evaporator 40.

The circuit further includes a step transformer 122 having a primary coil 124 electrically connected across wires L-1, N and a secondary coil 126 defining the power source to an electrically energized heater 128 in the grid assembly 14 for separating an ice slab into individual cubes for collection in the cavity 64. A tilt type mercury switch 130 is tripped to add heat to the thickness control from a bulb heater 132 connected across secondary winding 126 of the transformer 122. The switch 130 takes a resistor 134 out of series connection with the bulb heater 132 to accomplish this function.

By virtue of the aforedescribed system an ice making cycle of operation is initiated when the service switch 56 is closed. The bin thermostat switch 60 is closed to energize the motor windings 70, 72 of the compressor 32 thereby to cause refrigerant to flow through the evaporator coil 40 on the refrigerated plate assembly 12. Concurrently, an energization circuit for the water pump motor winding 98 is completed through the bin thermostatic switch 60, the thickness thermostat switch 86 and the movable contact 92 of the service switch 56. This circuit also completes the energization circuit for the condenser fan motor 112. As water is recirculated across the inclined plate assembly 12 an ice slab will build up thereon until a predetermined slab thickness is reached. At this point the ice slab thickness thermostat 86 will be conditioned to open the circuit for the pump motor winding 98 and the condenser fan motor 112 and will complete the energization circuit for the hot gas solenoid coil 118.

When the mercury switch 130 is closed the coil 106 is energized to condition the contacts 102, 104 to the illustrated position in FIG. 2 to terminate the condenser fan motor circuit between movable contact 102 and the fixed contact 110 of the harvest relay 100 and complete the contact between movable contact 104 and fixed contact 116 so as to maintain the hot gas solenoid coil 118 energized. This will open the solenoid valve 46 and cause hot gas to be directed through the evaporator 40. As the slab is released from the plate assembly 12 to slide onto the grid 14 the mercury switch 130 is tripped open thereby to open the hot gas solenoid circuit to terminate the hot gas defrost cycle of operation. This completes the circuit for the condenser fan motor coil 112 across contacts 102, 110 in preparation for another ice making cycle of operation.

In accordance with the present invention the control circuit 50 additionally includes a thermostat 136 wired in parallel with the bin thermostat control switch 60. The thermostat 136 includes a temperature sensing portion or housing body 138 located on the evaporator inlet tube 48 for sensing the temperature of refrigerant flow therethrough. During normal ice making cycles of operation the temperature sensing body 138 will sense cold refrigerant flow to maintain a bimetallic element 140 closed across contacts 142, 144 to maintain the compressor motor energization circuit, the water pump winding energization circuit and the condenser fan motor energization circuit energized. When the bin is unfilled the switch 60 maintains machine operation during hot gas defrost when element 140 senses hot refrigerant gas in inlet 48 to open.

When the bin ice level builds up to a point where the bin thermostat switch 60 opens the bimetallic element 140 will keep the refrigerant circuit operative during ice making modes since it will be closed while sensing the flow of cold refrigerant through the inlet 48 to the evaporator 40. As a result, even though the bin has been filled with ice the control circuit 50 will operate to maintain both refrigerant system operation and water recirculation until a predetermined slab thickness occurs on the refrigerated plate assembly 12. Heretofore, an electromechanical slab completion relay has been provided to maintain the machine operative following bin fill. In such cases, as soon as the ice slab thickness has been built up on the refrigerated plate assembly, the machine operation is terminated. At this point, ambient temperature is utilized to release the final slab build up on the refrigerated plate assembly 12 following bin fill. In such cases, the quality of the ice slab will be affected since the time required to release it by ambient temperature is such that the clarity of the ice slab may be affected. To assure that the final ice slab has the desired degree of clarity, in the present invention the bimetallic element 140 will remain closed to complete and maintain an energization circuit for the hot gas solenoid that is from wire L-1 through the movable contact 54 of the service switch 58 through the closed bimetallic element 140 thence through the ice thickness control switch 86 which has its movable contact 84 in engagement with the back contact 120 when the ice slab has reached its desired thickness and through the movable contact 104 of the harvest relay 100 which is in engagement with the back contact 116. Thus, the hot gas solenoid valve 46 will be energized to direct a flow of hot gas through the evaporator coil 40. The thermostat 136 will have a temperature sensing body 138 located at the inlet 48 to the evaporator 40 to sense hot gas flow therethrough. Eventually, the temperature of the bimetallic element 140 will be raised to a point to cause the bimetallic element 140 to open to thereby shut down the machine preventing further operation thereof in accordance with the filled bin condition. However, sufficient hot gas will have entered the evaporator 40 to separate the ice slab from the plate even though the bin cavity 64 has been filled. The release of the ice slab is accomplished in an assured fashion and in a time period that will prevent the clarity of the ice slab from being adversely affected. Therefore, it will slide onto the continuously energized grid assembly 14 and be separated into individual cubes to assure that all cubes directed into the cavity 64 will have an equally high quality.

While the embodiments of the present invention, as herein disclosed, constitute a preferred form, it is to be understood that other forms might be adopted.

What is claimed is:

1. In a slab type ice maker having an electrically driven compressor refrigerant system for flow of cold refrigerant through the inlet tube of an evaporator to cool an evaporator plate with water circulation produced thereover by electrically energized pump means for build up of an ice slab on the plate and including an electrically energized grid located below the plate for receiving an ice slab therefrom for subsequent separation into individual cubes to be received in an ice storage bin located below the grid, the improvement comprising: first circuit means for energizing the compressor and pump means including a slab thickness switch having first and second positions and bin level switch means responsive to ice accumulation within the bin, thermal delay relay means being operative to bypass the bin level switch means immediately upon maximum buildup of a predetermined ice level in the bin, an evaporator inlet tube, said thermal delay relay means including a bimetallic element and a temperature sensing portion located on said evaporator inlet tube for sensing the temperature of refrigerant therein, said bimetallic element being located in shunt relationship to the bin level switch means and in series connection with said slab thickness switch to maintain the compressor and pump means operative following maximum ice build up when said slab thickness switch is in its first position, defrost means energized when a predetermined ice thickness is sensed by said slab thickness switch to cause it to assume its second position, said defrost means including means to maintain a flow of hot gas through the evaporator inlet tube and evaporator to the slab to release it upon opening of the slab thickness switch, thereby to direct a fresh slab of ice onto the grid for division into the cubes representing a termination of a build up of ice therein and to assure the feed of an ice having the desired clarity into the bin at the end of each of the ice bin fill cycles of operation, said bimetallic disc being responsive to flow of hot gas through the evaporator inlet tube to concurrently terminate a defrost cycle and machine operation following a predetermined time delay when the bin is filled with ice.

2. In a slab type ice maker of the type including a mechanical compressor refrigerant system having a refrigerated plate cooled by an evaporator with an inlet tube for ice build up and water circulation means including a water pump motor operative during an ice making mode to pass water over the refrigerated plate and further including a hot gas defrost system for directing hot refrigerant gas from the compressor to the plate to remove an ice slab therefrom for division into individual cubes by a heater grid for collection in a bin, the improvement comprising: first circuit means for energizing the compressor including a bin level control switch, second circuit means for energizing the water pump motor including said bin level control switch and an ice slab thickness control switch having first and second positions, third circuit means for energizing the hot gas defrost system including said ice slab thickness control switch when in its second position and operative to maintain the hot gas defrost system off when the ice slab thickness switch is in its first position, a thermal switch having a bimetallic element and a temperature sensing portion located on the evaporator inlet tube for sensing the temperature of refrigerant therein, said temperature sensing portion maintaining said bimetallic element closed during an ice making mode of operation; said closed bimetallic element bypassing said bin level control switch to maintain the compressor and water circulation means operative following build up of a maximum level of ice in the bin; said ice slab thickness switch being responsive to a desired ice thickness build up to terminate water circulation and to condition said third circuit means to initiate a defrost cycle of operation; said temperature sensing portion to sense the flow of hot gas in the evaporator inlet tube to produce a time delayed control of the defrost system dependent upon the characteristics of said bimetallic element to produce a transient flow of hot gas through the refrigerated plate to cause release of the slab therefrom, said bimetallic element opening following the predetermined time delay to concurrently terminate the defrost cycle and deenergize the refrigerant and water recirculation systems.

* * * * *